United States Patent [19]

Wallace et al.

[11] Patent Number: 4,483,672

[45] Date of Patent: Nov. 20, 1984

[54] GAS BURNER CONTROL SYSTEM

[75] Inventors: Elmer E. Wallace, Fort Wayne; Jesse H. Turner, Auburn, both of Ind.

[73] Assignee: Essex Group, Inc., Fort Wayne, Ind.

[21] Appl. No.: 459,279

[22] Filed: Jan. 19, 1983

[51] Int. Cl.[3] ..... F23N 3/00

[52] U.S. Cl. ..... 431/20; 431/58; 431/18; 126/116 A; 236/15 C; 251/61.1

[58] Field of Search ..... 431/12, 19, 20, 90, 431/75, 58; 236/1 G, 1 H, 15 C, 45; 126/110 R, 116 R, 116 A; 110/186, 189; 251/61.1

[56] References Cited

U.S. PATENT DOCUMENTS

| | | | |
|---|---|---|---|
| 3,141,657 | 7/1964 | Fleer | 432/46 |
| 3,269,450 | 8/1966 | Licata et al. | 431/31 |
| 3,592,232 | 7/1971 | Good | 137/614.21 |
| 3,650,262 | 3/1972 | Root et al. | 126/110 |
| 4,009,861 | 3/1977 | Hirst | 251/61.1 |
| 4,334,855 | 6/1982 | Nelson | 431/20 |

*Primary Examiner*—Margaret A. Focarino
*Attorney, Agent, or Firm*—Robert D. Sommer

[57] ABSTRACT

A burner control system for gas fired apparatus of the powered blower vent type wherein a diaphagm valve for controlling the supply of gas to the main burner of the apparatus is operated by a gas bleed line which is subject to pressure regulation by a servo regulator valve. The bleed line is also subject to on-off control by pneumatically operated bleed valve means which are responsive to the subatmospheric fluid pressure produced in the exhaust vent of the apparatus by an exhaust blower to permit opening of the diaphragm valve only when the fluid pressure level within the exhaust vent is sufficiently below atmospheric pressure. The control system preferably includes switching circuit means which are effective to energize the exhaust blower only during the existence of a pilot burner flame adequate to ignite the main burner.

6 Claims, 5 Drawing Figures

GAS BURNER CONTROL SYSTEM

BACKGROUND OF THE INVENTION

This invention relates to gas burner control systems and in particular to an improved gas burner control system for gas fired apparatus of the powered vent or forced draft type.

Gas fired apparatus of the powered vent type utilizes a blower connected to the exhaust vent of a combustion chamber for drawing ambient air into the combustion chamber to ensure adequate combustion of gas at the main burner and for discharging exhaust gas or combustion products from the combustion chamber to the atmosphere by way of a flue or chimney. To avoid a safety hazard in the event of a blower malfunction or a blockage in the air inlet or the flue, pressure sensitive control devices have been employed to sense the pressure variation within the exhaust vent that is produced by operation of the blower. Such control devices act to prevent or discontinue burner operation when the fluid pressure developed by the blower is below a selected value.

One form of such pressure sensitive control devices disclosed in U.S. Pat. No. 3,650,260 is a pressure sensitive electric switch which senses the fluid pressure at the inlet of the exhaust blower to control the electrical energization of a burner gas supply valve. Another form disclosed in U.S. Pat. No. 3,141,657 is a pneumatically operated valve which opens to supply gas to a burner when inlet pressure at the exhaust blower is below a selected value. Examples of other pneumatically operated valves are disclosed in U.S. Pat. Nos. 3,269,450 and 3,592,232.

The aforementioned pressure sensitive control devices are employed with other burner control apparatus which commonly includes a combination gas manifold control of the type disclosed in U.S. Pat. No. 4,009,861. Such a combination control comprises a diaphragm main valve operated between on-off positions and regulating positions by a bleed line system which controls the supply of a gas operating pressure to a diaphragm chamber with a servo regulator valve and an electromagnetically operated control valve. To prevent opening of the diaphragm main valve when the fluid pressure developed by the exhaust blower is inadequate, a pressure sensitive electrical switch is generally employed to control the application of power to the electromagnetically operated control valve. Although such pressure sensitive switches of a reliable construction are relatively costly, the alternate use of a separate pneumatically operated valve serially connected with the combination gas manifold control is even more costly and requires substantial installation space.

It also has been proposed in U.S. Pat. No. 4,334,855 to modify a conventional combination gas manifold control to incorporate a pneumatically operated flapper valve section and a gas servo pressure regulator section which are each responsive to differential pressures produced by the flow of exhaust gas through a flow restricting orifice in an exhaust stack induced by a variable-speed blower. Communication of the differential pressure to the servo regulator section is controlled by the flapper valve section which has an "on" state when the pressure differential exceeds a first predetermined value and an "off" state when the differential pressure falls below a second predetermined value. In the "on" state of the flapper valve section, gas operating pressure is supplied by the servo regulator section to the diaphragm chamber of a diaphragm main valve which regulates the rate of gas flow to a main burner in proportion to the sensed differential pressure. It will be evident that the foregoing arrangement is rather complex and expensive and therefore is not particularly suitable for low cost installations of gas fired apparatus such as heating furnaces in homes and apartment buildings.

SUMMARY OF THE INVENTION

An improved gas burner control system for gas fired apparatus of the powered vent type according to the present invention includes a control device responsive to the fluid pressure level within the exhaust vent of the apparatus which is of low manufacturing cost and reliable operation and can be readily incorporated in a conventional combination control wherein a diaphragm main valve for controlling the supply of gas to the main burner of the apparatus is operated by a gas bleed line which is subject to pressure regulation by a servo regulator valve. The control device comprises a bleed valve conneced in the gas bleed line of the combination control for effecting control of the diaphragm main valve in an on-off manner and a pneumatic actuator having an expansible chamber in fluid communication with the exhaust vent and subject to fluid pressure in the exhaust vent. The expansible chamber is operatively connected to the bleed valve for effecting opening of the bleed valve when the fluid pressure in the exhaust vent drops below a first predetermined subatmospheric pressure level and for effecting the closing of the bleed valve when the fluid pressure in the exhaust vent rises above the first pressure level to a second predetermined subatmospheric pressure level.

A burner control system in accordance with a preferred embodiment of the invention further includes a pilot burner for igniting gas flowing from the main burner, electrically operated ignition means for igniting gas flowing from the pilot burner, and a flame sensor switch responsive to the presence of flame at the pilot burner to complete an electric circuit for rendering the exhaust blower operative. Thus, a gas operating pressure effective to open the diaphragm main valve is supplied through the bleed line by the bleed valve only when the fluid pressure in the exhaust vent drops below a predetermined subatmospheric pressure level as a result of the initiation of blower operation in response to the establishment of flame at the pilot burner.

For a better understanding of the invention, reference may be had to the following detailed description taken in connection with the accompanying drawings, in which:

DESCRIPTION OF THE PREFERRED EMBODIMENT

Figure 1:
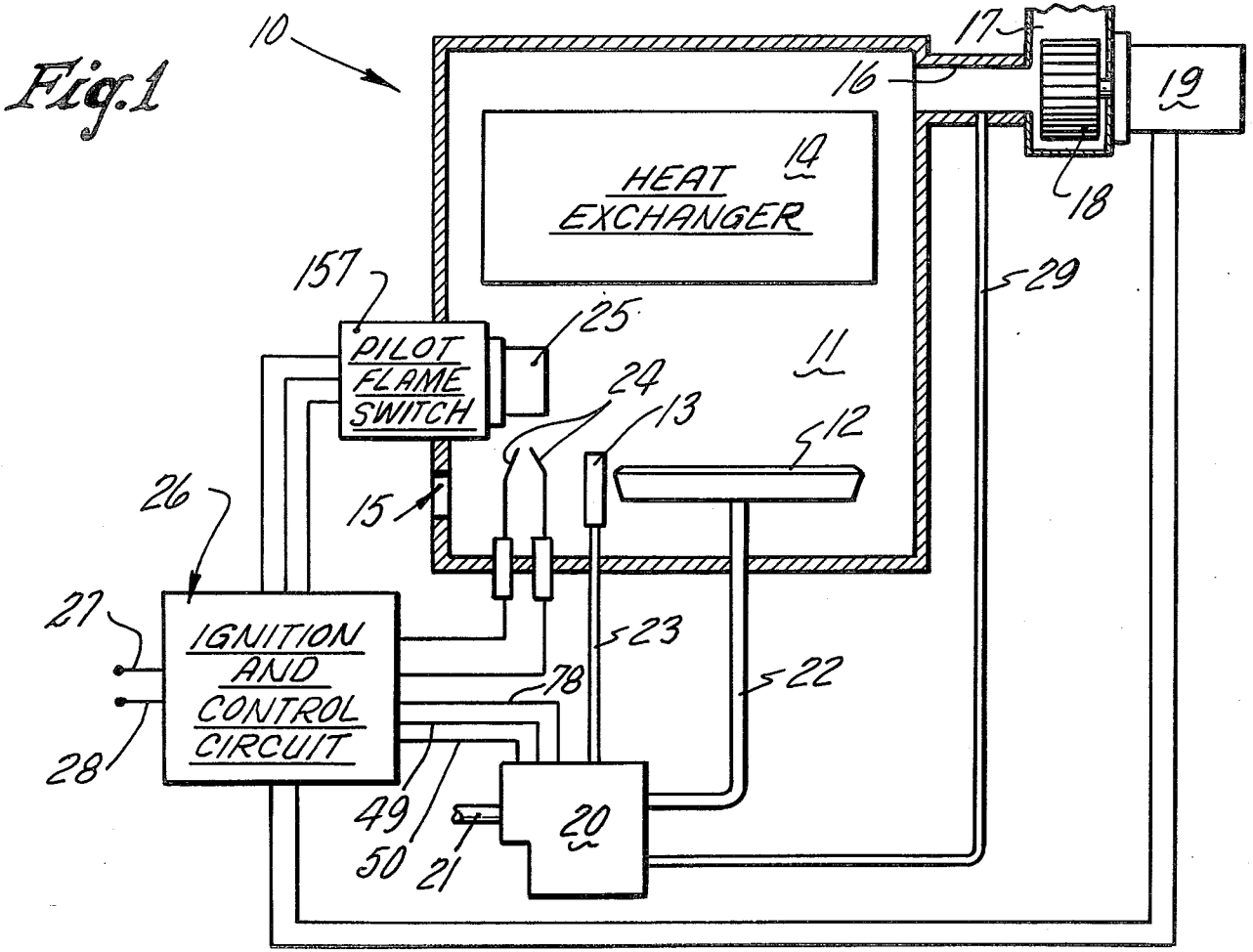
FIG. 1 is a diagrammatic illustration of gas fired apparatus including a burner control system embodying the invention.

Referring to FIG. 1 of the drawings, there is shown gas fired apparatus 10 such as a heating furnace having a combustion chamber 11 within which is disposed a main gas burner 12 and a pilot burner 13. A heat exchanger 14 is disposed in heat-transfer relationship with the combustion chamber 11 and, in the case of a hot air furnace, has a fan (not shown) for circulating air therethrough. Ambient air is supplied to the burners 12 and 13 through an opening 15 into the combustion chamber 11 and the combustion products or flue gas produced by the burners pass upwardly through the heat exchanger 14 to an exhaust vent 16 connecting the combustion chamber 11 to a flue, stack or chimney 17 and thence to the atmosphere. A blower 18 driven by an electric motor 19 is operatively connected to the exhaust vent for drawing ambient air through the opening 15 into the combustion chamber 11 and for expulsion of air and combustion products to the atmosphere through the flue 17.

Gas supply control apparatus 20 such as a combination gas manifold control includes valve means to be subsequently described for controlling flow of gas from a supply conduit 21 to the main burner 12 through a main conduit 22 and to the pilot burner 13 through a pilot conduit 23. The pilot burner 13 is disposed in igniting proximity to the main burner 12 and ignition means such as spark ignition electrodes 24 are disposed adjacent the pilot burner 13 for igniting gas flowing therefrom. A flame sensor 25 is also disposed adjacent the pilot burner 13 to sense the presence or absence of flame at the pilot burner. Energization of the blower motor 19, the control apparatus 20, and the ignition electrodes 24 is controlled by an ignition and control circuit which is indicated by the block 26 in FIG. 1 and which includes various components to be subsequently described. The ignition and control circuit 26 is connected to a source of electric power (not shown) by conductors 27 and 28. Fixed to the exhaust vent 16 within an opening formed therein is a fluid conduit 29 for transmission of fluid existing in the exhaust vent to one section of the control apparatus 20.

Figure 2:
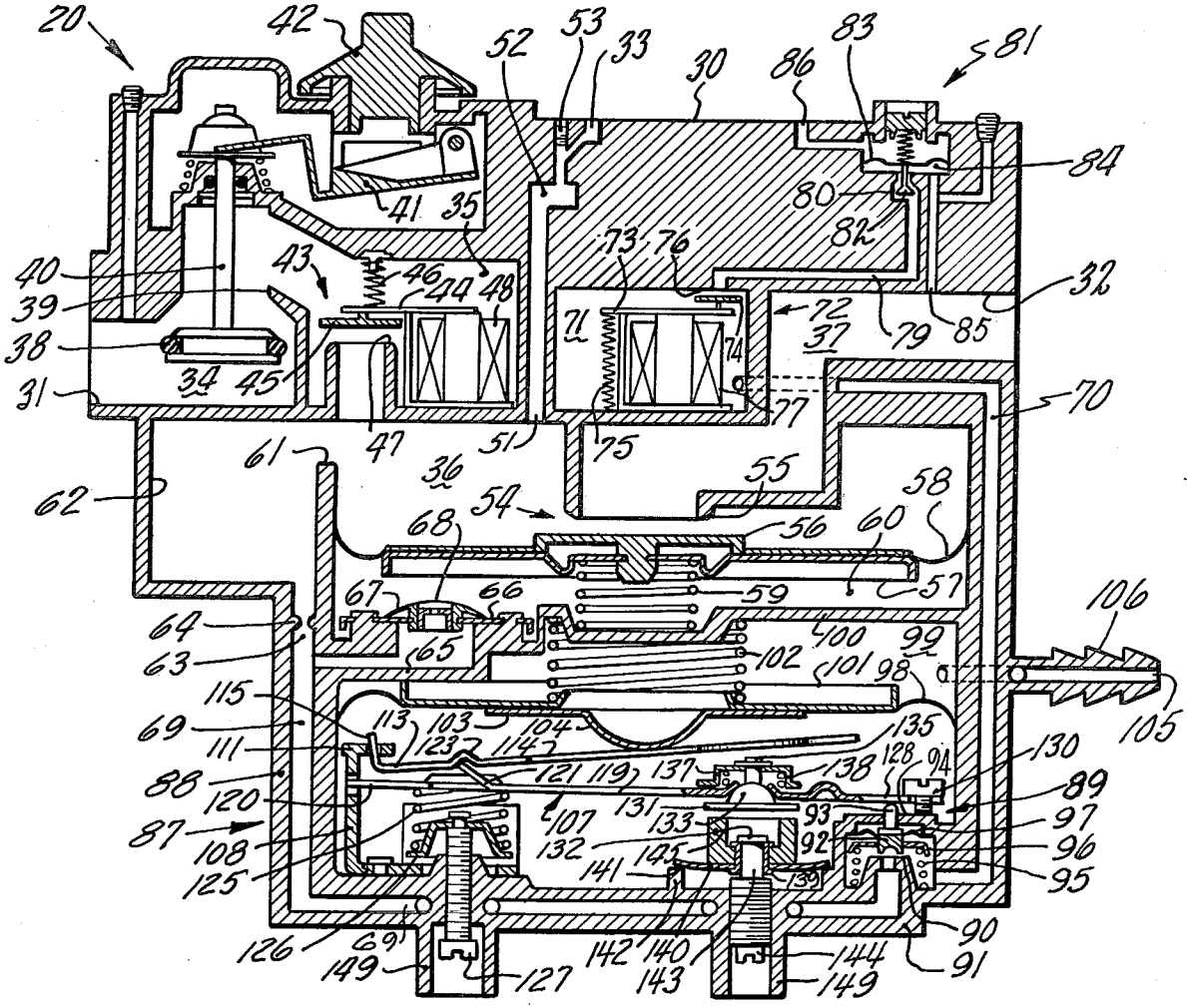
FIG. 2 is a cross-sectional, partially schematic illustration of a combination control used in the invention shown in its open operating condition.
Figure 3:
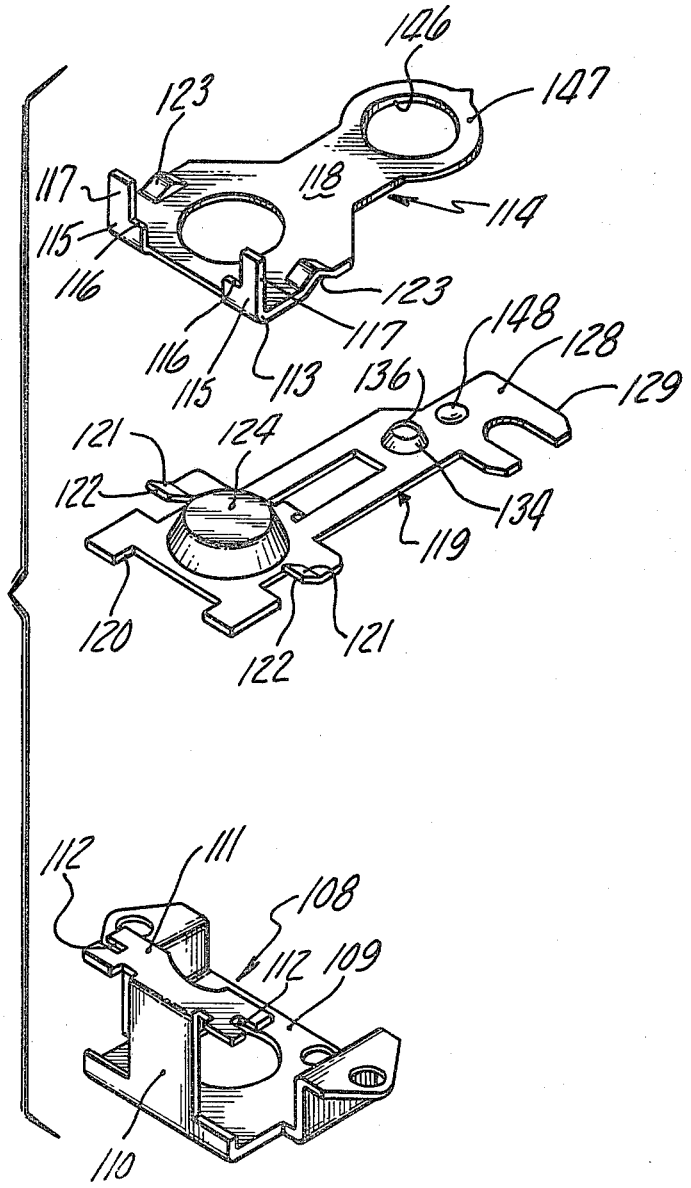
FIG. 3 is a perspective view of certain components of the combination control of FIG. 2 in a semi-exploded relationship.

As schematically illustrated in FIG. 2, the control apparatus 20 includes a housing 30 having an inlet 31, a main burner outlet 32 and a pilot burner outlet 33, all of which are internally threaded for connection respectively to the conduits 21, 22 and 23. A main gas passageway connecting the inlet 31 with the main outlet 32 includes an inlet chamber 34, a redundant valve chamber 35, a main valve chamber 36, and an outlet chamber 37. A biased closed, manually operated shutoff valve member 38 in the chamber 34 cooperates with a valve seat 39 formed at the outlet of chamber 34 to control all gas flow through the control apparatus 20. The valve member 38 has a spring-biased stem 40 operatively connected by a lever 41 with an operating knob 42 for movement of the valve member 38 between open and closed positions. Further details of such a shutoff valve are described in the Turner et al U.S. Pat. No. 4,354,633 issued Oct. 19, 1982.

An electrically operated redundant valve 43 in chamber 35 includes a pivotally mounted lever 44 carrying a valve member 45 biased by a spring 46 against a valve seat 47 which is formed at the outlet of the chamber 35. The valve member 45 is moved to an open position by the attraction of the lever 44 to an electromagnet 48 when the latter receives electric power through conductor leads 49 and 50 (FIG. 1). Downstream of the redundant valve 43, a pilot flow passage 51 extends from the chamber 36 to the pilot outlet 33 and includes an enlarged pilot flow filter chamber 52. A screw type restrictor valve 53 is disposed in the pilot flow passage 51 for adjustably setting the rate of pilot gas flow.

A diaphragm operated main valve 54 includes a valve seat 55 formed at the outlet of the main chamber 36 and a valve member 56 carried by a back-up plate 57 which is attached to the underside of a flexible diaphragm 58. The main valve member 56 is biased in a closed position on the valve seat 55 by a compression spring 59. The periphery of the diaphragm 58 is sealingly attached to the housing 30 to define an operating pressure chamber 60 below the diaphragm 58. The main valve member 56 is movable by the diaphragm 58 between on-off positions and regulating positions in response to variations in the differential gas pressure existing between the chambers 36 and 60.

Gas bleed path means to supply a gas operating pressure for the chamber 60 include a bleed flow port 61 in a wall of the chamber 36 which defines an inlet to a filter cavity 62 in the housing 30. A bleed flow passage 63 having two branch bleed lines communications with the outlet of the filter cavity 62 through a flow restrictor 64. The first branch bleed line includes a passage 65 terminating in a valve seat 66 that communicates with the operating pressure chamber 60. A check valve flapper disc 67 closes against the valve seat 66 and has a flow restricting orifice 68 therein. The second branch bleed line includes two serially connected bleed passages 69 and 70 communicating with a bleed flow chamber 71 in the housing 30. An electrically operated bleed control valve 72 in the chamber 71 includes a pivotally mounted lever 73 carrying a valve member 74 biased by a spring 75 against a valve seat 76 which is formed at the outlet of the chamber 71. The valve member 74 is moved to an open position by attraction of the lever 73 to an electromagnet 77 when the latter receives electric power through conductor leads 49 and 78 (FIG. 1).

A bleed passage 79 connected to the valve seat 76 terminates in the valve seat 80 of a conventional servo pressure regulator valve 81 which further includes a valve member 82 carried by a spring-biased flexible diaphragm 83. The valve seat 80 leads to a pressure regulating chamber 84 which in turn communicates with a bleed passage 85 leading to the main outlet chamber 37. A vent passage 86 vents the space above the diaphragm 83 to atmosphere whereby the pressure regulator valve 81 senses outlet pressure from the main valve 54.

As thus far described, the control apparatus 20 is generally similar to known forms of combination gas manifold controls and the function of its various components will be readily apparent to those skilled in the art. It is to be noted that these various components can be of any desired structures. Furthermore, a check valve member such as the flapper disc 67 is not necessarily required in order to practice the present invention.

In the improved control apparatus 20 of the present invention, a pneumatically operated valve assembly 87 is connected in the gas bleed path means for controlling the supply of gas operating pressure to the operating pressure chamber 60. Although the pneumatically operated valve assembly 87 need not be an integral part of the control apparatus 20, it is preferably provided with a casing 88 which is secured in suitably sealed relation to the housing 30. The casing 88 is internally bored for extension of the bleed passages 69 and 70 of the gas bleed path means to a bleed valve 89 comprising a valve seat 90 formed in the base 91 of the casing. A bleed valve member 92 is movable relative to the valve seat 90 by a valve operating pin 93 which extends through a bleed valve cover 94. A compression spring 95 bears against a spring retainer 96 fastened to the valve member 92 to urge the valve member to an open position away from the valve seat 90. The valve member 92 has a peripheral flange portion 97 that is sealingly secured to the base 91 by any suitable means.

A pneumatic actuator for operating the bleed valve 83 includes a flexible diaphragm 98 sealingly secured at its periphery to the casing 88 and cooperating with the upper hollow portion of the casing to define an expansible chamber 99 closed at its upper end by the housing wall 100 of the operating pressure chamber 60. A back-up plate 101 is secured to the upper side of the diaphragm 98 and a coil spring 102 is mounted in compression between the wall 100 and the back-up plate 101 to bias the diaphragm 98 in a direction away from the wall 100. A second back-up plate 103 is secured to the lower side of the diaphragm 98 and is centrally embossed to provide a generally hemispherical driver or thrust member 104. In communication with the expansible chamber 99 is the bore 105 of a fluid pressure inlet fitting 106 that is fixed and sealed to the casing 88. The fitting 106 is adapted for connection to the fluid conduit 29 (FIG. 1) that leads to the exhaust vent 16 of the gas fired apparatus 10 for subjecting the expansible chamber 99 to the fluid pressure existing in the exhaust vent. The lower hollow portion of the casing below the diaphragm 98 is subject to atmospheric pressure.

Disposed within the hollow lower portion of the casing 88 are bleed valve operating means including a lever assembly 107 which operatively connects the expansible chamber 99 to the bleed valve 89 for moving the latter between open and closed positions. The lever assembly 107 includes a fulcrum bracket 108 having a base section 109 secured to the base 91 and an upstanding leg section 110 terminating in an outwardly turned flange section 111 which has notches 112 in opposite lateral edges thereof. One end 113 of a rigid diaphragm lever 114 is pivotally mounted upon the flange section 111 by means of upwardly bent tabs 115 having shoulder portions 116 bearing against the underside of the flange section 111 and finger portions 117 extending upwardly through the notches 112. The driver 104 carried by the diaphragm 98 is urged by the spring 102 into engagement with an intermediate portion 118 of the diaphragm lever 114 spaced from the pivotally mounted end 113 so as to bias the diaphragm lever 114 in a clockwise direction as viewed in FIG. 2.

A rigid valve lever 119 generally coextensive with the diaphragm lever 114 has a first notched end 120 in pivotal engagement with the leg section 110 of the bracket 108. Adjacent the first end 120, abutment tongues 121 lanced from the opposite sides of the valve lever 119 project therefrom at an angle of 45° toward the diaphragm lever 114. An upper edge 122 at the free end of each tongue 121 is received in a corresponding upwardly indented valley portion 123 of the diaphragm lever 114 to provide a distinct line of mating contact therebetween. The valve lever 119 has a cup-shaped embossed portion 124 which is centered with respect to the upper edges 122 of the tongues 121. A helically coiled spring 125 is held in compression between the bottom surface of the cup-shaped portion 124 and a frustro-conically shaped retainer 126 which is adjustably secured to the base 91 by an adjusting screw 127. Rotation of the adjusting screw 127 serves to adjust the compressive force of the spring 125 by varying the position of the retainer 126. The spring 125 which has a line of action substantially aligned with the upper edges 122 of the tongues 121 biases the tongues into mating engagement with the valley portions 123 of the diaphragm lever 114 and thereby acts on the diaphragm lever 114 to urge the same into pivotal engagement with the flange section 111 of the bracket 108. Both the valve 119 and the diaphragm lever 114 are biased by the spring 125 in a counterclockwise direction as viewed in FIG. 2.

The second end 128 of the valve lever 119 bears against the operating pin 93 of te bleed valve 89. Pivotal movement of the valve lever 119 in a clockwise direction to depress the operating pin 93 seats the valve member 92 against the valve seat 90 to close the bleed valve 89. The end 128 of the valve lever 119 is provided with a lateral extension 129 which is bifurcated to straddle a stop screw 130 threaded in the bleed valve cover 94 with its head engagable by the top of the extension 129. The head of the screw 130 thus serves as a stop to limit pivotal movement of the valve lever 119 in a counterclockwise direction.

To provide an operating differential which enables the bleed valve 89 to close in response to one pressure level in the chamber 99 and to open in response to a different pressure level in the chamber 99, the valve lever 119 carries a disc-like armature 131 adjacent its end 128 in opposed relation to a permanent magnet 132 which is supported on the base 91 adjacent the bleed valve 89. A ball portion 133 formed on one side of the armature 131 is seated in a corresponding spherical socket 134 formed in the valve lever 119. A stem 135 extending from the ball portion 133 through an opening 136 at the center of the socket 134 has a spring retainer 137 secured to its outer end. A compression spring 138 extends between the retainer 137 and the valve lever 119 to keep the ball portion 133 seated in the socket 134 but permits a universal movement of the ball portion 133 for alignment of the armature 131 with the permanent magnet 132. An eyelet 139 secures the permanent magnet 132 to the intermediate portion 140 of a leaf spring 141 which has opposite ends bearing against spaced bosses 142 projecting from the base 91. The neck 143 of a magnetic gap adjustment screw 144 threaded in the base 91 extends through the leaf spring 141 and the eyelet 139 and has a head 145 at its free end engaging the eyelet 131 to hold the leaf spring 141 against the bosses 142 in a flexed or bowed condition. Rotation of the adjustment screw 144 varies the position of the permanent magnet 132 relative to the base 91 and thus serves to adjust the spacing between the permanent magnet 132 and the armature 131.

An opening 146 is provided in the diaphragm lever 114 for permitting the armature stem 135 and the spring retainer 137 to pass through the lever 114 when the latter moves toward the valve lever 119. Although the free end 147 of the diaphragm lever 114 will not ordinarily move into engagement with the valve lever 119, the latter may be provided with a raised boss 148 to limit physical contact between the two levers upon over-travel of the diaphragm lever 114.

As shown in FIG. 2, the components of the pneumatically operated valve assembly 87 are in the respective operating positions they have when the expansible chamber 99 is subject to a subatmospheric fluid pressure which is produced in the exhaust vent 16 with normal operation of the blower 18. Since the lower side of the diaphragm 98 is subject to atmospheric pressure, the force of the pressure differential acting upon the diaphragm 98 exceeds the force of the spring 102 to urge the diaphragm 98 upwardly to the retracted position shown in FIG. 2. The valve lever 119 is pivoted counterclockwise against the stop screw 130 by the spring 125 which acting through the tongues 121 causes the diaphragm lever 114 to be pivoted counterclockwise against the driver 104. Since the operating pin 93 of the bleed valve 89 is outwardly extended, the valve member 92 is in an open position permitting bleed gas flow through the valve seat 90.

When operation of the blower 18 is terminated, the fluid pressure within the exhaust vent 16 and the expansible chamber 99 begins to rise to atmospheric pressure. As the blower speed drops, the fluid pressure within the expansible chamber 99 rises to a somewhat higher subatmospheric pressure level to decrease the force of the differential pressure acting on the diaphragm 98 with an increasing resultant downward force exerted upon the driver 104 by the spring 102. The driver 104 is thus extended downwardly to pivot the diaphragm lever 114 clockwise about the flange section 111 of the bracket 108. With such pivotal movement, the diaphragm lever 114 exerts a force upon the edges 122 of the valve lever 119 which acts to cause a downward sliding motion of the notched edge 120 along the leg section 110 of the bracket 108. As this sliding motion is opposed by the force of the spring 125, the force exerted upon the edges 122 by the diaphragm lever 114 also causes the valve lever 119 to pivot clockwise about the leg section 110. When the clockwise pivotal movement of the valve lever 119 carries the armature into the field of the magnet 132, the magnetic attractive force between the magnet 132 and the armature 131 rapidly increases with approach of the armature to the magnet until a point is reached where the armature 131 snaps into attracted relation with the magnet 132. The resulting snap action movement of the valve lever 119 at this point simultaneously acts through the valve operating pin 93 to effect a snap action closing of the bleed valve 89.

If operation of the blower 18 is again initiated, the resulting decrease in the fluid pressure level within the expansible chamber 99 causes an upward retraction of the diaphragm 98 against the force of the spring 102. The force of the spring 125 acting through the tongues 121 of the valve lever 119 upon the diaphragm lever 114 pivots the latter counterclockwise about the flange section 111 of the bracket 108 to maintain the diaphragm lever 114 in following engagement with the driver 104. As the notched end 120 of the valve lever 119 rides upwardly along the leg section 111 under the biasing force of the spring 125 during this pivotal movement of the diaphragm lever 114, the freedom of movement between the valve lever 119 and the armature 131 afforded by the ball portion 133 permits the armature 131 to remain in attracted relation to the permanent magnet 132. When the fluid pressure within the expansible chamber 99 drops further to predetermined subatmospheric pressure level at which the net moment of spring forces acting on the valve lever 119 reaches a value which exeeds the attractive force between the armature 131 and the magnet 132, the armature is released by the magnet and the valve lever 119 pivots counterclockwise with a snap action. The simultaneous release of the valve operating pin 93 from its depressed postion effects a snap action opening of the bleed valve 89.

By rotating the adjusting screw 127 to vary the compression of the spring 125, the fluid pressure level within the expansible chamber 99 at which the bleed valve 89 operates may be adjusted. To adjust the differential pressure of the bleed valve means 87, that is, to adjust the difference between the fluid pressure levels at which the expansible chamber 99 effects opening and closing of the bleed valve 89, the magnetic gap adjustment screw 144 is rotated to change the magnetic gap between the armature 131 and the magnet 132 in the attracted position thereof. The casing 88 may include bushings 149 surrounding the outwardly projecting ends of the screws 127 and 124 which may be filled with a sealing substance after calibration of the bleed valve means to prevent tampering.

Figure 4:
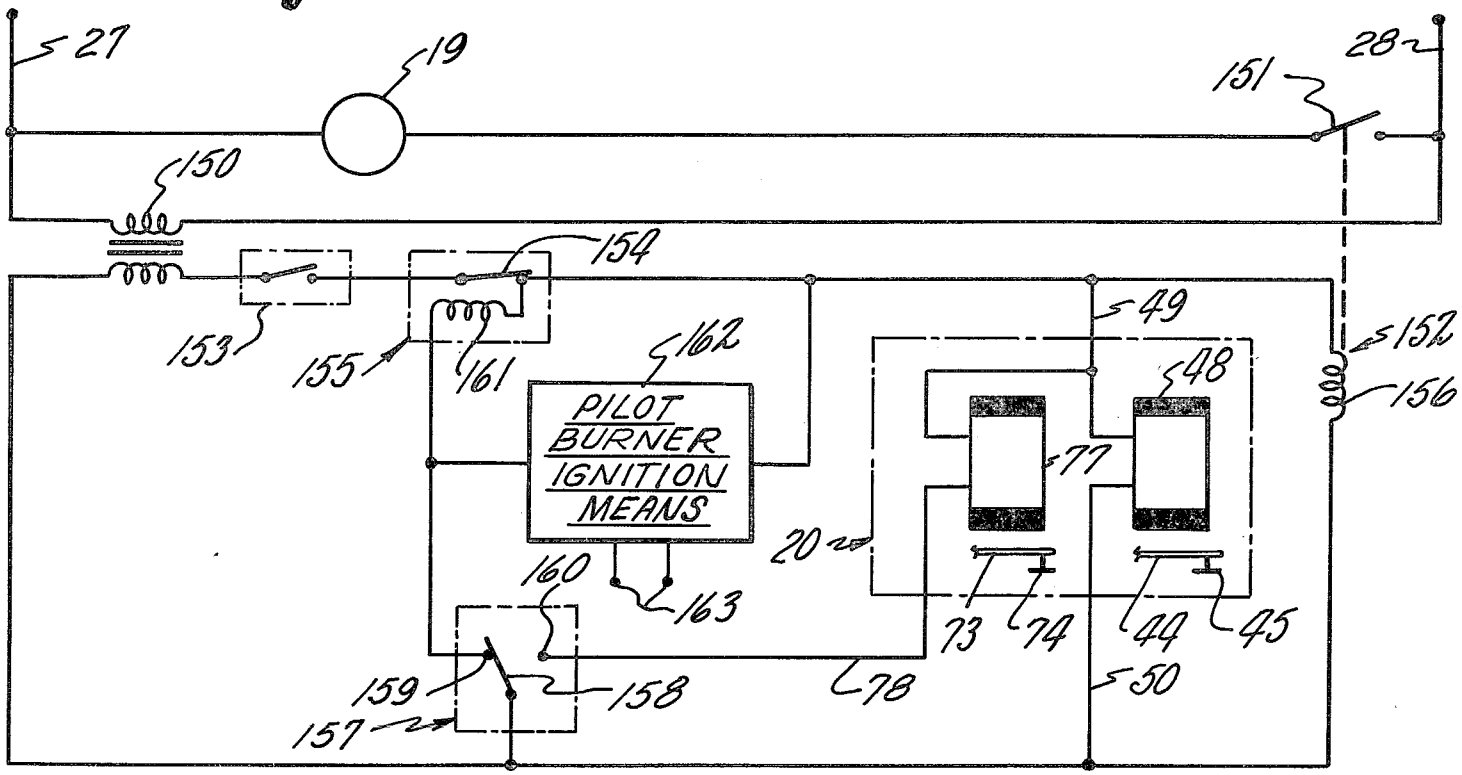
FIG. 4 is a circuit diagram schematically showing one burner control system for the gas fired apparatus of FIG. 1.
Figure 5:
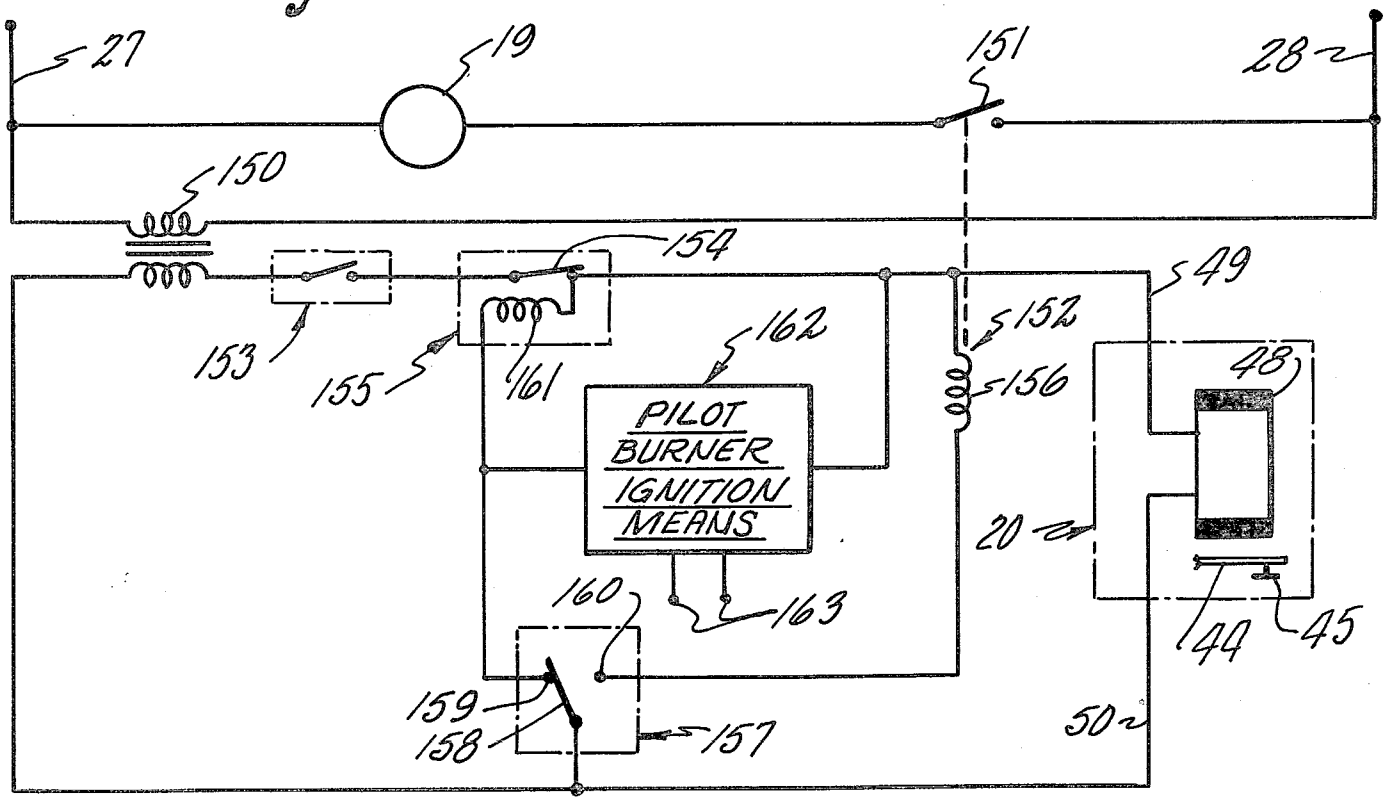
FIG. 5 is a circuit diagram schematically showing a modified burner control system for the gas fired apparatus of FIG. 1.

FIGS. 4 and 5 schematically illustrate respective electrical circuits for gas burner ignition and control systems which include the various components of the ignition and control circuit 26 in addition to certain other previously mentioned elements of the gas fired apparatus 10. The system of the circuit shown in FIG. 4 utilizes the control apparatus 20 in the form illustrated in FIG. 2 while the preferred system of the circuit shown in FIG. 5 utilizes a control apparatus 20 in which the electrically operated control valve 72 is omitted.

In the circuit of FIG. 4, the primary winding of a transformer 150 is connected to a suitable source of alternating current power by the conductors 27 and 28. The blower motor 19 and the normally open contacts 151 of a relay 152 are connected in series across the conductors 27 and 28. A conventional thermostat 153, the normally closed contacts 154 of a conventional time delay switch 155, and the actuator coil 156 of the relay 152 are connected in series across the secondary of the transformer 150. The electromagnet 48 of the redundant valve 43 is connected in parallel with the actuator coil 156. A pilot flame switch 157 has a contact arm 158 movable between two contacts 159 and 160 to selectively connect the delay operating coil 161 of the time delay switch 155 or the electromagnet 77 of the electrically operated control valve 72 in parallel with the actuator coil 156. The contact arm 158 is operable by the flame sensor 25 to move from the contact 159 to the contact 160 when flame is present at the pilot burner 13 and to return to the contact 159 in the absence of flame at the pilot burner 13. Electrically energizable pilot burner ignition means 162 of the spark generating type are connected in parallel with the delay operating coil 161 and have output terminals 163 connected to the spark ignition electrodes 24.

The operation of the gas fired apparatus 10 with the ignition and control system disclosed in FIG. 4 will now be described. When the thermostat 153 is open, no electric power is supplied to the electromagnets 48 and 77 and the respective redundant valve 43 and control valve 72 are closed. As the blower motor 19 is also deenergized, the expansible chamber 99 is at atmospheric pressure with the diaphragm 98 extended to maintain the bleed valve 89 closed. The shutoff valve member 38 will ordinarily be in the normally open position shown in FIG. 2. With the redundant valve 43 closed, the valve chamber 36 and the operating pressure chamber 60 are vented to the atmosphere through the pilot outlet 33 and the outlet chamber 77 is vented to the atmosphere through the main outlet 32. Thus, there is no pressure difference between the opposite sides of the diaphragm 58 and the spring 59 is effective to bias the main valve member 56 in a closed position on the valve seat 55.

When the thermostat 153 closes upon a need for operation of the gas fired apparatus 10, the electromagnet 48 is energized, causing the redundant valve 43 to open, thereby permitting gas flow into the main valve chamber 36 and thence to the pilot burner 13. At the same time, the check valve disc 67 opens to admit gas into the operating pressure chamber 60 until the gas pressures in chambers 36 and 60 substantially equalize to maintain the main valve member 56 in a closed position by the spring 59. Simultaneously, the ignition means 162 are energized to provide sparks at the electrodes 24 for igniting gas flowing from the pilot burner. In addition, the relay actuator coil 156 is energized to close the contacts 151, thereby energizing the blower motor 19. Upon the blower 18 attaining its normal speed, the fluid pressure in the expansible chamber 99 drops to a subatmospheric pressure level causing extension of the diaphragm 98 to open the bleed valve 89.

In normal operation, the gas issuing from the pilot burner 13 will be ignited by the sparks at the electrodes 24 and the flame switch 157 will be operated by the flame sensor 25 to move the contact arm 158 from the contact 159 into engagement with the contact 160. The electromagnet 77 of the control valve 72 will then be energized and both the ignition means 162 and the delay operating coil 161 will be deenergized. If the pilot burner 13 failed to ignite and the delay operating coil 161 remains energized, then the time delay switch 155 will open its contacts 154 after a predetermined time interval to remove power from the electromagnet 48, thereby shutting off the supply of gas to the pilot burner 13.

After opening of the control valve 72 in response to energization of the electromagnet 77 and opening of the bleed valve 87 in response to operation of the blower 18 are effected, gas is immediately bled off from passage 65 to the main outlet 32 through passages 69, 70, 85 and valves 89, 72, 81 at a rate greater than that at which gas is supplied through the restrictor 64 in passage 63. The orifice 68 in the check valve disc 67 restricts the bleed flow of gas from the operating pressure chamber 60 to the passage 65 and accordingly the pressure in the chamber 60 will be gradually reduced. As the pressure differential between the main valve chamber 36 and the chamber 60 increases, there is a gradual opening movement of the main valve 54. Gas will now flow to the main burner 12 to be ignited by the flame at the pilot burner 13. After continued opening movement of the main valve, the gas pressure in the operating pressure chamber 60 and consequently, the degree of opening of the main valve 54 will be regulated by the servo pressure regulator valve 81 to maintain a predetermined outlet pressure at the main outlet 32.

The main burner 12 and the pilot burner 13 will continue to burn until the thermostat 153 opens, whereupon the valves 43 and 72 instantly close and the bleed valve 89 closes thereafter when the fluid pressure in the exhaust vent 16 drops below a predetermined subatmospheric pressure level as the blower 18 slows to a stop. The existing gas pressure in the operating pressure chamber 60 exhausts to the main outlet 32 permitting closure of the main valve 54 under the bias of the spring 59. When the pilot burner flame is extinguished, the contact arm 158 of the flame switch 157 is returned to engagement with the contact 159.

It will be seen from the foregoing that the opening of the main valve 54 is dependent not only upon the existence of a flame at the pilot burner 13 but also upon the existence of a predetermined subatmospheric pressure level in the exhaust vent 16 effective to cause opening of the bleed valve 89 by the expansible chamber 99. Thus operation of the main burner is initiated only when the subatmospheric pressure within the vent 16 decreases below a level which ensures that an adequate volume of air will be supplied to the burner. If the subatmospheric pressure within the exhaust vent 16 has, for example, a negative gauge pressure value of about 0.35 inch water when the volume of air supplied by the blower 18 is that required for 100 percent combustion at the main burner 12, the bleed valve means 87 may be calibrated to open the bleed valve 89 at a first negative gauge pressure value of 0.6 water and to reclose the bleed valve 89 upon a change in fluid pressure to a second negative gauge pressure value of 0.4 inch water. Accordingly, it will be seen that if during normal burner operation the pressure level within the vent 16 rises above the second negative gauge pressure value, the bleed valve 89 will be closed to effect closing of the main valve 54.

In the modified circuit of FIG. 5, circuit elements identical to those of FIG. 4 ar designated by the same reference numerals. In the burner ignition and control system of this embodiment, the control valve 72 in omitted from the control apparatus 20 and the actuator coil 156 of the relay 152 is connected between the contacts 154 of the time delay switch 155 and the contact 160 of the pilot flame switch 157. In many respects, the operation of the gas fired apparatus 10 with the ignition and control system disclosed in FIG. 5 is similar to that described in connection with FIG. 4. When the thermostat 153 closes, the electromagnet 48 is energized to open the redundant valve 43 and the pilot burner ignition means become operative. Gas issuing from the pilot burner 13 is ignited by sparks at the electrodes 24. When the presence of flame at the pilot burner is sensed by the flame sensor 25 to cause movement of the contact arm 158 to move from contact 159 to contact 160, the actuator coil 156 of the relay 152 is energized to close the contacts 151, thereby energizing the blower motor 19. Upon the blower 18 attaining its normal speed, the fluid pressure in the expansible chamber 99 drops to a subatmospheric pressure level causing extension of the diaphragm 98 to open the bleed valve 89. The opening of the bleed valve 89 changes the bleed operating pressure supplied to the operating pressure chamber 60 to effect opening of the main valve 54. Gas will now flow to the main burner 12 to be ignited by the flame at the pilot burner 13. The operating pressure in the chamber 60 is then regulated by the servo pressure regulator valve 81 to effect a regulating movement of the main valve 54. Upon opening of the thermostat 153, the redundant valve 43 instantly closes and the bleed valve 89 closes thereafter when the fluid pressure in the exhaust vent 16 drops below a predetermined subatmospheric pressure level as the blower 18 slows to a stop. Thus, the ignition and control system illustrated in FIG. 5 provides the same operating functions as those of the system illustrated in FIG. 4 with the advantage of not requiring the electrically operated control valve 72.

While there has been described above the principles of this invention in connection with specific gas burner control apparatus and systems, it is to be understood that this description is made only by way of example and not as a limitation to the scope of the invention.

What is claimed is:

1. In gas fired apparatus having a combustion chamber with a gas burner and an exhaust vent, an exhaust blower connected to the vent for drawing ambient air into the combustion chamber and for discharging air and combustion products from the combustion chamber to the atmosphere, and gas supply control apparatus having a housing with an outlet connected to the burner and a diaphragm operated main valve connected between the outlet and an inlet to control the flow of gas from a source to the burner, the control apparatus having bleed path means for effecting operation of the main valve and a servo pressure regulator valve connected in the bleed path means responsive to outlet pressure from the main valve for effecting regulating movement of the main valve to maintain a substantially uniform gas pressure at the outlet; the improvement comprising:

biased closed bleed valve means fluidly connected in series with said servo pressure regulator valve in the bleed path means of said control apparatus and movable between open and closed positions to effect control of said main valve in an on-off manner independently of said servo pressure regulator valve;

a pneumatic actuator having an expansible chamber in fluid communication with said exhaust vent and subject to fluid pressure in said exhaust vent; and said expansible chamber being operatively connected to said bleed valve means for moving the same between open and closed positions; said expansible chamber effecting the opening of said bleed valve means when the fluid pressure in said exhaust vent drops below a first predetermined subatmospheric pressure level and effecting the closing of said bleed valve means when the fluid pressure in said exhaust vent rises above said first pressure level to a second predetermined subatmospheric pressure level which is greater than said first pressure level.

2. The invention of claim 1 wherein said pneumatic actuator comprises a casing, a flexible diaphragm carried by said casing to define said expansible chamber on one side of said diaphragm with the other side being subjected to atmospheric pressure; and biasing means within said expansible chamber acting upon said diaphragm in a direction to close said bleed valve means and yieldable to permit movement of said diaphragm in an opposite direction upon a reduction of the pressure level within said expansible chamber to a subatmospheric pressure level; and wherein said other side of said diaphragm is operatively connected to said bleed valve means by operating means including lever means pivotally mounted in said casing; said operating means including magnetic means comprising an armature carried by said lever means and a permanent magnet mounted in said casing which are in magnetically attracted relation when said bleed valve means are closed.

3. The invention of claim 2 wherein said casing includes a base facing said other side of said diaphragm and supporting in adjacent relationship said permanent magnet and said bleed valve means; and wherein said lever means include a rigid diaphragm lever pivotally mounted at one end thereof with a first portion thereof in operational engagement with said diaphragm, a rigid valve lever generally coextensive with said diaphragm lever and pivotally mounted at a first end thereof adjacent said one end of said diaphragm lever, abutment means on said valve lever adjacent said first end thereof in engagement with said diaphragm lever, and spring means acting upon said valve lever for maintaining said abutment means in engagement with said diaphragm lever and thereby maintaining said diaphragm lever in operational engagement with said diaphragm, said valve lever having a second end for operationally engaging said bleed valve means, said armature being carried by said valve lever at a location adjacent said second end thereof in opposed relation to said permanent magnet and cooperable therewith for urging movement of said valve lever from a position thereof in which said bleed valve means are open to a position in which said bleed valve means are closed.

4. The invention of claim 3 wherein said lever means include a fulcrum bracket mounted on said base and comprising an upstanding leg section terminating in an outwardly turned flange section; said diaphragm lever being pivotally mounted at its said one end upon said flange section and said valve lever being pivotally mounted at its said first end upon said leg section; said spring means including a helically coiled compression spring disposed with its line of action substantially aligned with said abutment means and acting through said abutment means to urge said diaphragm lever into pivotal engagement with said flange section.

5. In a gas burner ignition and control system for gas fired apparatus having a combustion chamber with a main gas burner and an exhaust vent;

an electrically operated exhaust blower connected to the vent for drawing ambient air into the combustion chamber and for discharging air and combustion products from the combustion chamber to the atmosphere;

gas supply control apparatus having a diaphragm operated main valve for connecting said main burner to a source of gas when an operating gas pressure is supplied to the diaphragm operator of the main valve; said control apparatus having gas bleed path means for supplying an operating pressure to said diaphragm operator and a servo pressure regulator valve connected in the bleed path means responsive to outlet pressure from the main valve for effecting regulating movement of the main valve;

main burner ignition means including a pivot burner for igniting gas flowing from the main burner and electrically energizable pilot burner ignition means for igniting gas flowing from the pilot burner; and flame sensing means including a flame sensor responsive to the presence or absence of flame at the pilot burner and electric switching means operable by the flame sensor to have a conductive condition in the presence of flame at the pilot burner and a non-conductive condition in the absence of flame at the pilot burner;

the improvement comprising:

electrical circuit means completed through said electric switching means when in the conductive condition thereof for rendering said exhaust blower operative only in the presence of flame at the pilot burner; and pneumatically operated bleed valve means connected in the bleed path means and controlling the supply of gas operating pressure to said diaphragm operator; said bleed valve means comprising pneumatic actuating means in fluid communication with said exhaust vent and subject to fluid pressure in said exhaust vent for operating said bleed valve means to supply an operating pressure to said diaphragm operator effective to open said main valve only when the fluid pressure in said exhaust vent drops below a predetermined subatmospheric pressure level as a result of the initiation of blower operation by said electrical circuit means in response to the establishment of flame at the pilot burner.

6. In a gas burner ignition and control system for gas fired apparatus having a combustion chamber with an exhaust vent;

an electrically operated exhaust blower connected to the vent for drawing ambient air into the combustion chamber and for discharging air and combustion products from the combustion chamber to the atmosphere;

a main burner within the combustion chamber;

a pilot burner for igniting gas flowing from the main burner;

gas supply control apparatus comprising a housing having an inlet for connection with a gas supply, a main outlet for connection with the main burner, a pilot outlet for connection with the pilot burner, and a main gas passageway connecting said inlet and said main outlet;

a first electrically controlled valve in said main gas passageway;

a biased closed main valve in said main gas passageway downstream from said first valve;

a pilot flow passage extending from said main gas passageway at a point betweeen said first valve and said main valve to said pilot outlet;

diaphragm means operatively connected to said main valve for moving the same between on-off positions and regulating positions;

gas bleed path means in said housing for supplying an operating pressure on said diaphragm means;

a servo pressure regulator valve connected in the bleed path means and responsive to outlet pressure from the main valve to regulate the operating pressure on said diaphragm means for effecting regulating movement of said main valve;

electrically energizable ignition for igniting gas flowing from the pilot burner; and flame sensing means including a flame sensor responsive to the presence or absence of flame at the pilot burner and electric switching means operable by the flame sensor to have a conductive condition in the presence of flame at the pilot burner and a non-conductive condition in the absence of flame at the pilot burner;

the improvement comprising:

electrical circuit means completed through said electric switching means when in the conductive condition thereof for rendering said exhaust blower operative only in the presence of flame at the pilot burner;

bleed valve means connected in said bleed path means and operable independently of said pressure servo regulator valve; said bleed valve means having closed and open positions controlling the operating pressure on said diaphragm means to respectively prevent and permit opening of said main valve;

a pneumatic actuator having an expansible chamber in fluid communication with said exhaust vent and subject to fluid pressure in said exhaust vent; and said expansible chamber being operatively connected to said bleed valve means for moving the same between said closed and open positions; said expansible chamber effecting the opening of said bleed valve means when the fluid pressure in said exhaust vent drops below a first predetermined subatmospheric pressure level and effecting the closing of said bleed valve means when the fluid pressure in said exhaust vent rises above said first pressure level to a second predetermined subatmospheric pressure level which is greater than said first pressure level.

* * * * *